United States Patent [19]

Lee

[11] Patent Number: 4,727,779

[45] Date of Patent: Mar. 1, 1988

[54] CORK SCREW

[76] Inventor: Wen-Hsin Lee, 4th Fl., No. 61, Liu-Ho I Road, Kaohsiung, Taiwan

[21] Appl. No.: 33,171

[22] Filed: Apr. 1, 1987

Related U.S. Application Data

[63] Continuation-in-part of Ser. No. 872,121, Jun. 9, 1986, Pat. No. 4,677,883.

[51] Int. Cl.[4] ..... B67B 7/04

[52] U.S. Cl. ..... 81/3.37; 81/3.29; 81/3.45

[58] Field of Search ..... 81/3.37, 3.29, 3.45, 81/3.33, 3.36, 3.07, 3.08, 3.48, 3.31, 3.32; D8/40, 42

[56] References Cited

U.S. PATENT DOCUMENTS 344,566 6/1886 Cluever ..... 81/3.29

420,572 2/1890 Edie ..... 81/3.33

OTHER PUBLICATIONS

Tire-Bouchon, Par. M. Perille, PL II, FIG. 7, Apr. 15, 1876.

*Primary Examiner*—Debra Meislin

[57] ABSTRACT

A cork screw which comprises a pedestal and a rotary handle incorporating a stem and a penetrating screw wherein the pedestal incorporates a dog member to engage with a helical groove of the stem and a spring biased sleeve around the stem to cause the dog member to engage with the helical groove when the handle is turned in a certain direction and disengage therefrom when a cork is pulled entirely out of a bottle. A holding member is incorporated in the pedestal to hold a cork after it has been pulled out of a bottle.

7 Claims, 7 Drawing Figures

CORK SCREW

This application is a continuation-in-part application of U.S. patent application Ser. No. 872,121 filed June 9, 1986, now U.S. Pat. No. 4,677,883 issued on July 7, 1987.

BACKGROUND OF THE INVENTION

This invention relates to a cork screw construction and particularly to one having a rotary handle incorporating a stem and a penetrating screw, and a housing pedestal to be seated against a spout of a bottle, wherein an improved engaging dog member is mounted in the pedestal and a sliding sleeve is provided around the stem to cause the dog member to engage with and disengage from a helical groove of the stem upon rotation of the handle.

The basic application of this application discloses a cork screw of the above described type but with two fulcrumed dog members at two opposite outer sides of the pedestal. In operation, the dog members are first manipulated to be in a position disengaging from the helically grooved stem before the handle is rotated to cause the screw to penetrate the cork. The helical groove of the stem and the screw are arranged in such a manner that they are not in the same screw direction, i.e. if the screw is right-handed, the helical groove of the stem is left-handed. During the handle rotation, the dog members return to their normal position engaging with the stem, causing the stem to turn upward and pulling the screw upward. The above described cork screw is still inconvenient since the dog members must be depressed by hand to a position disengaging from the stem before the rotation of the handle.

SUMMARY OF THE INVENTION

An object of the invention is to provide a cork screw which can be manipulated in a manner more convenient than conventional cork screws.

Another object of the invention is to provide a cork screw with a sanitary holding member that can prevent a pulled out cork from being polluted by a hand when the cork is reused.

The present invention provides a cork screw which comprises, a rotary handle, a stem connected to the handle and having a helical groove extending on the periphery of the stem, a penetrating screw fixed to the bottom of the stem, a hollow pedestal having an upper surrounding wall portion receiving the stem and a lower portion having a cross-section greater than the upper wall portion and adapted to be seated against a spout of a bottle, the upper wall portion having a hole therein, a sliding sleeve surrounding the stem and fitted in the upper wall portion in an axially slideable position, the sleeve having an opening aligned radially with the hole, a dog member pivotally mounted in the hole and having an engaging end extending into the opening, the engaging end extending to the interior of the sleeve through the opening and engaging the stem when the opening is at a first level relative to the hole, and a spring means for biasing the sleeve to move the opening to a second level higher than the first level so as to retract the engaging end.

In one aspect of the invention, the cork screw further comprises a holding member which can be inserted in and separated from the pedestal, the holding member including a substantially cylindrical hollow base member and a plurality of separate upstanding clamping members which are of one piece with and extending from the base member at annularly spaced apart positions and each of which has an inwardly projecting clamping face, and a tongue-and-groove engagement means to interengage the holding member and the pedestal.

The present exemplary preferred embodiment will be described in detail with reference to the following drawings, in which:

DETAILED DESCRIPTION OF THE PREFERRED EMBODIMENTS

Figure 2:
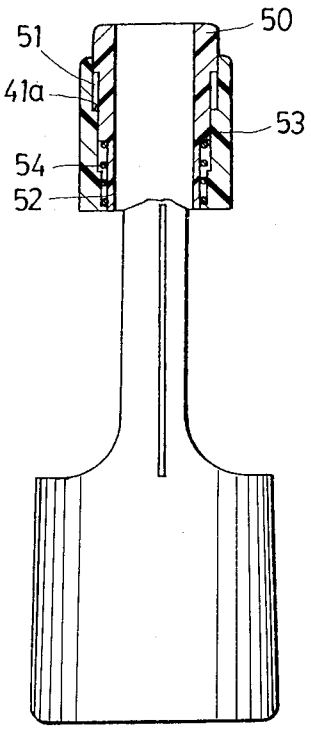
FIG. 2 is a fragmentary elevation view of the cork screw of FIG. 1.
Figure 1:
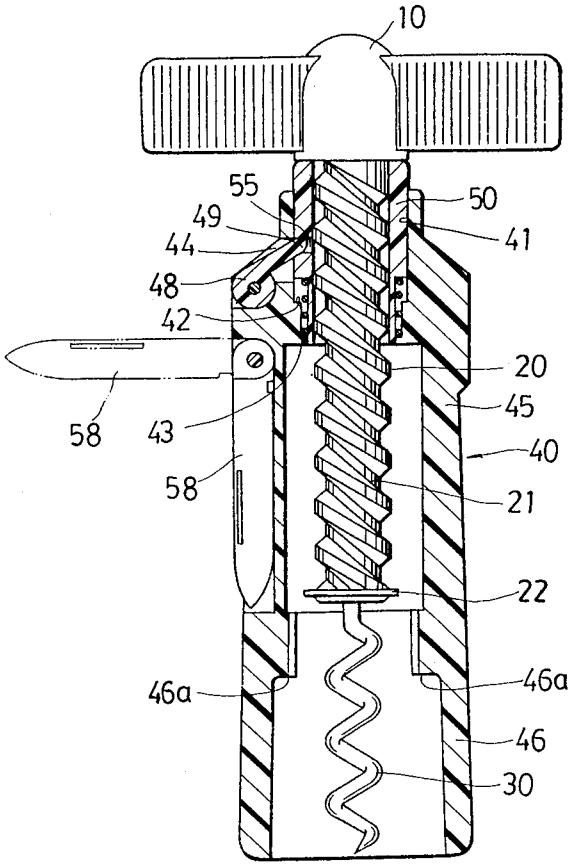
FIG. 1 is a sectional view of a first embodiment of a cork screw according to the present invention.
Figure 3:
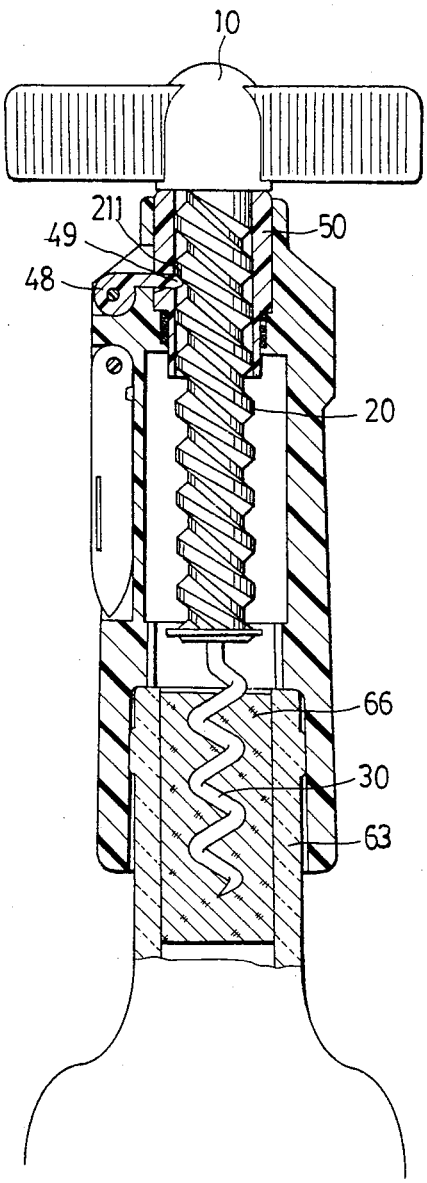
FIG. 3 is a sectional view showing that the penetrating screw of the cork screw of FIG. 1 penetrates into a cork.

Referring to FIGS. 1, 2, and 3, a preferred embodiment of a cork screw according to the present invention is shown, having a rotary handle 10 connected to a stem 20 having a helical groove 21 extending on its periphery, and a penetrating screw 30 connected to the stem 20. Around the stem 20 and the cork screw 30 is a one-piece pedestal 40 which includes an upper cylindrical surrounding wall portion having a cylindrical inner periphery 41 with a first annularly stepped portion 42 and a second annularly stepped portion 43. Two axial column 45 extend downwardly from two diametrically opposite positions of the pedestal 40, carrying a substantially cylindrical portion 46 which has two inwardly projecting flanges 46a to abut against a spout 63 of a bottle. A hole 44 is disposed in the top portion of one of the columns 45 and in the upper wall portion of the pedestal.

In the hole 44 is mounted pivotally a dog member 48 which has an engaging end 49. A sleeve 50 is fitted slideably in the upper portion of the pedestal and sleeved around the stem 20. On the inner periphery 41 of the pedestal 40 is two diametrically opposite axial projections 41a to engage with two axial grooves 51 of the sleeve 50, whereby the sleeve 50 slides only in an axial direction relative to the pedestal 40. The sleeve 50 has a neck portion 52 and an annular shoulder 52 which combine with the annularly stepped portions 42 and 43 to confine a space for receiving a spring 54. The spring 54 normally biases the sleeve 50 upward. The sleeve 50 further has an opening 55 aligned radially with the hole 44 of the pedestal 40, and the engaging end 49 of the dog member 48 extend into the opening 55, thereby preventing the sleeve from releasing out of the pedestal.

In one of the columns 45 of the pedestal 40 is pivoted a knife 58 which can be pulled out of the column 45 for use. The knife 58 can be used to cut a plastic sealing sheet (not shown) that wraps around a spout of a bottle by placing the spout against the cutting edge of the knife 58 and the column 45 and then rotating the bottle.

Normally, the engaging end 49 of the dog member 48 does not extend into the interior of the sleeve 50 due to the action of the spring 54 to move the sleeve 50 upward. When one turns the handle 10 to cause the penetrating screw 30 to penetrate into a cork 66 of a bottle, the handle moves towards and depressed the sleeve 50 so that the sleeve slides downward against the action of the spring 54 until the engaging end 49 of the dog member 48 extends into the interior of the sleeve 50 and engages with the stem 20. As soon as the engaging end 49 engages the stem 20, the continuous turning of the handle 10 in the same direction causes the stem 20 to rotate and move upward relative to the pedestal 40, thereby lifting the cork from the bottle. The engaging end 49 of the dog member 48 does not disengage from the helical groove 21 of the stem 20 until the cork is pulled entirely out of the bottle. This is because the engaging end 49 is prevented from moving upward by its engagement with the ridge surface 211 confining the helical groove 21 due to the stem 20 which is subjected to a downward force caused by the cork still held in the bottle, as better shown in FIG. 3. When the cork is pulled entirely out of the bottle, the downward force disappears and the engaging end 49 is moved upward by the action of the spring 54 and disengages from the helical groove 21. The stem 20 is restricted from moving out of the pedestal by its flange 22 which can engage with the inner surface of the pedestal. With the sleeve 50, the cork screw can pull out a cork just by simply rotating the handle 10 in one direction without a need to operate manually the dog member.

Figure 4:
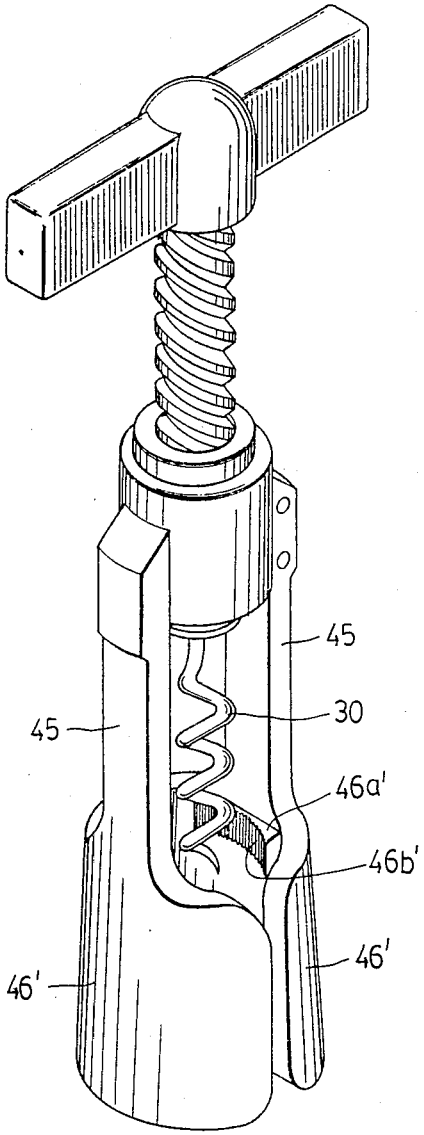
FIG. 4 is a perspective view of a second embodiment of the invention.

FIG. 4 shows a second embodiment of the invention, wherein elements similar to that of the first embodiment are designated by similar reference numerals. This embodiment is substantially similar to the first embodiment except for that two semi-cylindrical bottom members 46' are provided to replace the cylindrical member 46 which is connected to the two columns 45. On the inner surfaces of the semi-cylindrical bottom members are provided respectively two inwardly projecting clamping members **46*a'* each with a toothed clamping surface 46*b'*. When the two semi-cylindrical bottom members 46' are squeezed, the inwardly projecting clamping members 46*a'* will clamp the cork which is pulled out of the bottle. While clamping the cork, the penetrating screw 30 can be released from the cork by rotating the handle in the direction opposite to that which causes the penetrating screw 30** to penetrate into the cork.

Figure 5:
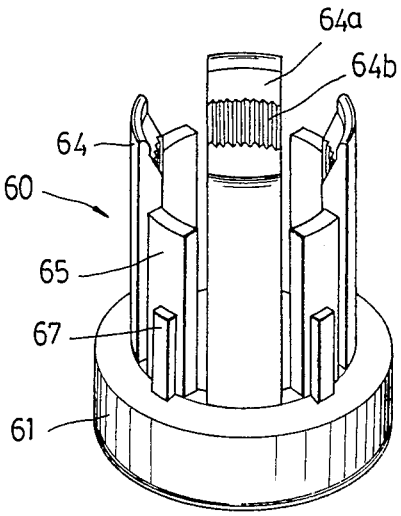
FIG. 5 shows a holding member to be incorporated in the cork screw of FIG. 1.
Figure 7:
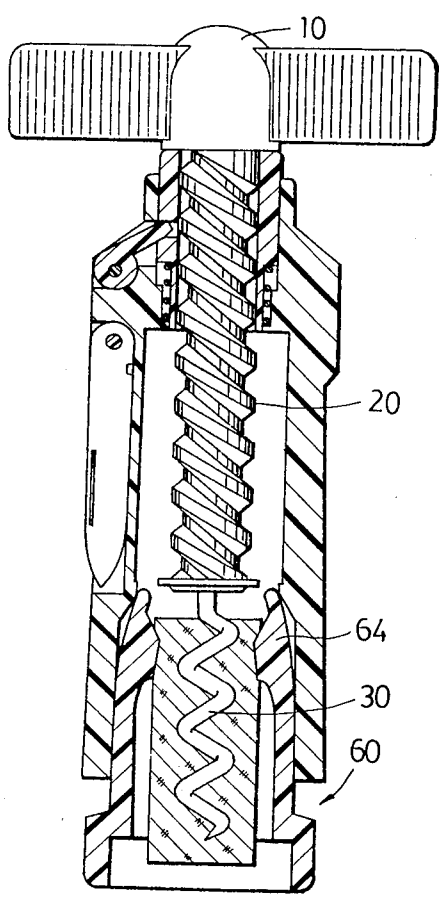
FIG. 7 is a sectional view showing another application of the holding member.
Figure 6:
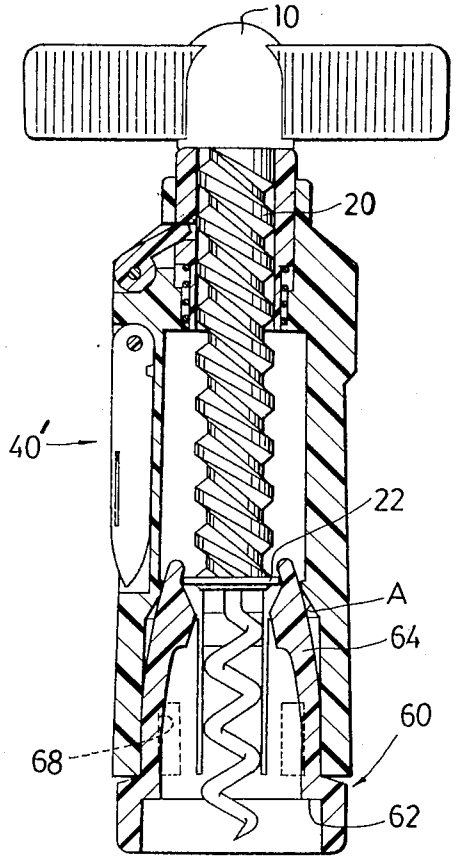
FIG. 6 is a sectional view showing an application of the holding member.

FIGS. 5 through 7 show a third embodiment of the present invention wherein elements similar to that of the first embodiment are designated by similar reference numerals. In comparison with the first embodiment, this embodiment additionally includes a holding member 60 detachably inserted in the pedestal 40'. The holding member 60 includes a substantially cylindrical hollow base portion 61 having an inner shoulder formation 62 to abut against the spout of a bottle, and an upper clamping portion extending upwardly from the top of the cylindrical base portion 61. The upper clamping portion has a plurality of upstanding clamping members 64 and upstanding blocks 65 oriented annularly and slightly spaced apart from each other. The clamping members 64 are longer than the upstanding blocks 65 and are provided with clamping projections **64*a* with toothed clamping surfaces 64*b*. The clamping members 64 are disposed alternatingly with respect to the upstanding blocks 65. On the outer sides of the upstanding blocks 65 are provided axially extending tongues 67. When the holding member 60 is press fitted in the lower portion of the pedestal 40', the tongues 67 are engaged in axial grooves 68 provided in the inner side of the pedestal 40', preventing the member 60 from rotation relative to the pedestal 40'**.

The holding member 60 can be used to hold the stem 20 in the pedestal 40' when the device is not in use, and to clamp a cork and separate it from the penetrating screw 30 after the cork is pulled out of the bottle. When the member 60 is inserted into the pedestal as shown in FIG. 6, the clamping members 64 are bent inwardly by inwardly projecting members A of the pedestal 40' and thus clamp the flange 22 of the stem 20, thereby holding the stem 20 against an outward movement.

After the penetrating screw 30 pulls out a cork, the cork can be removed from the penetrating screw 30 by inserting the member 60 into the pedestal 40' as shown in FIG. 7. The clamping members 64 clamp the cork and prevent it from moving together with the penetrating screw 30 when the penetrating screw is moved upward by turning the handle 10 or stem 20 is turned in a direction opposite to that which causes the penetrating screw to move downward. If the pulled out cork is to be re-inserted into the spout of a bottle one may seat the base member 61 of the holding member 60 against the spout and depress the top side of the cork to cause the cork to enter the spout. The holding member provides an advantage in that a pulled out cork will not be polluted by hand when it is either pulled out of or put into the spout.

With the invention thus explained, it is apparent that various modifications and variations can be made without departing from the scope of the invention. It is therefore intended that the invention be limited as indicated in the appended claims.

What I claim is:

1. A cork screw comprising:

a rotary handle;

a stem connected to said handle and having a helical groove extending on the periphery of said stem;

a penetrating screw fixed to the bottom of said stem;

a hollow pedestal having an upper surrounding wall portion receiving said stem and a lower portion having an internal cross-section greater than an internal cross-section of said upper wall portion and adapted to be seated against a spout of a bottle, said upper wall portion having a hole therein, a sliding sleeve surrounding said stem, fitted in said upper wall portion in an axially slideable position, said sleeve having an opening aligned radially with said hole;

a dog member pivotally mounted to said upper wall portion and within said hole and having an engaging end extending into said opening, said engaging end extending to the interior of said sleeve through said opening and engaging said stem when said opening is at a first level relative to said hole; and a spring means for biasing said sleeve to move said opening to a second level higher than said first level so as to retract said engaging end in said opening.

2. A cork screw as claimed in claim 1, wherein said sleeve has an upper portion extending outwardly of said upper wall portion by the action of said spring means.

3. A cork screw as claimed in claim 1, wherein an inner surface of said upper wall portion has an annularly stepped portion, and said sleeve having a lower tubular neck portion, said annularly stepped portion and said tubular neck portion confining a space for receiving said spring means.

4. A cork screw as claimed in claim 1, wherein said upper wall portion of said pedestal is defined by a cylindrical first hollow member, and said lower portion includes two diametrically opposing axial column members extending from the periphery of said cylindrical hollow member, and a substantially cylindrical second hollow member connected to the lower ends of an in one-piece with said column members, said second hollow member having an inwardly extending flange to abut with the spout of the bottle.

5. A cork screw as claimed in claim 1, wherein said upper wall portion of said pedestal is defined by a cylindrical first hollow member, and said lower portion includes two diametrically opposing axial column members extending from the periphery of said cylindrical hollow member, and two separate semi-cylindrical members each having an inwardly extending curved flange on the inner surface of said semi-cylindrical member and each connected to each of said column members, each of said curved flanges having an axially curved toothed surface.

6. A cork screw as claimed in claim 1, further comprising a holding member which can be inserted in and separted from said pedestal, said holding member including a substantially cylindrical hollow base member and a plurality of separate upstanding clamping members which are of one piece with and extending from said base member at annularly spaced apart positions and each of which has an inwardly projecting clamping face, and a tongue-and-groove engagement means to interengage said holding member and said pedestal.

7. A cork screw as claimed 6, wherein said hollow base member has an inner side with a shoulder formation to abut with a spout of a bottle.

* * * * *